US006155618A

United States Patent [19]

Ichinose

[11] Patent Number: 6,155,618

[45] Date of Patent: Dec. 5, 2000

[54] STRIKER FOR VEHICLE DOOR LATCH DEVICE

[75] Inventor: Mikio Ichinose, Yamanashi-ken, Japan

[73] Assignee: Mitsui Kinzoku Kogyo Kabushiki Kaisha, Tokyo, Japan

[21] Appl. No.: 09/327,522

[22] Filed: Jun. 8, 1999

[30] Foreign Application Priority Data

Jun. 9, 1998 [JP] Japan ..... 10-176585

[51] Int. Cl.[7] ..... E05B 15/02

[52] U.S. Cl. ..... 292/340; 292/216; 292/DIG. 65

[58] Field of Search ..... 292/340, 341.11, 292/341.12, 341.17, 341.18, 216, DIG. 23, DIG. 65

[56] References Cited

U.S. PATENT DOCUMENTS

| | | | |
|---|---|---|---|
| 4,466,645 | 8/1984 | Kobayashi | 292/341.12 |
| 4,650,231 | 3/1987 | Shimura et al. | 292/340 |
| 4,911,488 | 3/1990 | Brackmann et al. | 292/216 |
| 5,050,917 | 9/1991 | Hamada et al. | 292/340 |
| 5,209,531 | 5/1993 | Thau | 292/216 |
| 5,209,532 | 5/1993 | Nakamura et al. | 292/216 |
| 5,382,062 | 1/1995 | Kostler | 292/340 |
| 5,529,356 | 6/1996 | Cetnar | 292/340 |
| 5,785,365 | 7/1998 | Lorey | 292/216 |
| 5,842,728 | 1/1999 | Umino | 292/216 |
| 5,860,683 | 1/1999 | Sekino et al. | 292/216 |
| 6,042,160 | 3/2000 | Hamada et al. | 292/216 |

*Primary Examiner*—B. Dayoan
*Assistant Examiner*—Clifford B Vaterlaus
*Attorney, Agent, or Firm*—Browdy and Neimark

[57] ABSTRACT

A striker for a vehicle door latch device comprises a metal base plate fastened to a vehicle body, a U-shaped metal rod fastened to the base plate and projected toward a vehicle door, and a block member formed on the base plate. The block member comprises a block stay projected from the base plate toward the door and a block portion formed at a tip of the block stay. The block portion is opposed to an inside metal panel of the door when the door is closed. The block portion is brought into contact with the inside metal panel, when the inside metal panel is deformed by an external force to approach the base plate.

8 Claims, 5 Drawing Sheets

STRIKER FOR VEHICLE DOOR LATCH DEVICE

BACKGROUND OF THE INVENTION

1. Technical Field of the Invention

The present invention relates to a striker for a vehicle door latch device.

FIGS. 9 and 10 show a conventional striker A fastened to a vehicle body B and a conventional door latch device C fastened to a vehicle door D. The striker A comprises a metal base plate E and a substantially U-shaped metal rod F fastened to the base plate E.

2. Prior Art

In the conventional arrangement, when the door D was largely deformed by an external force of an accident or the like, in some cases, the door D could not easily be opened even if the engagement between the striker A and the latch device C were released. One of the reasons is that as shown in FIG. 11, an inside metal panel G of the door D which has been deformed rearward toward the striker A enters the interior side of the striker A so that the panel is engageably opposed to the striker, and this makes it difficult to open the door D.

SUMMARY OF THE INVENTION

Accordingly, it is an object of the present invention to provide a striker in which an engagement between the inside panel and the striker, which makes it difficult to open the door, cannot easily be caused, even if the inside metal panel of the door D is deformed rearward by the external force.

DESCRIPTION OF THE PREFERRED EMBODIMENT

Figure 1:
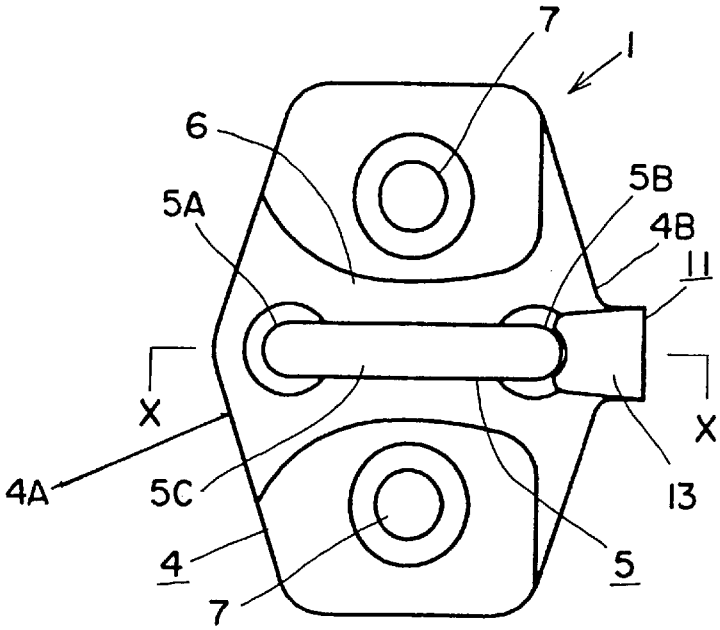
FIG. 1 is a front view of a striker according to the present invention.
Figure 2:
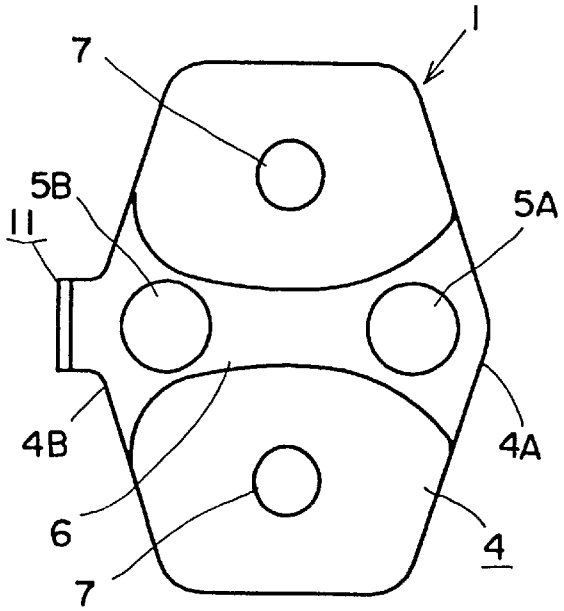
FIG. 2 is a rear view of the striker.
Figure 3:
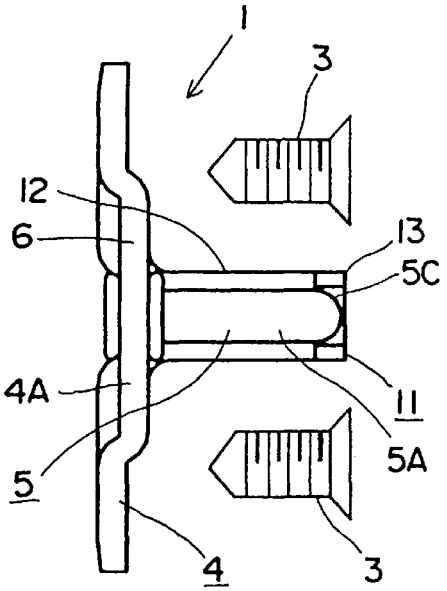
FIG. 3 is a side view showing an exterior side of the striker.
Figure 4:
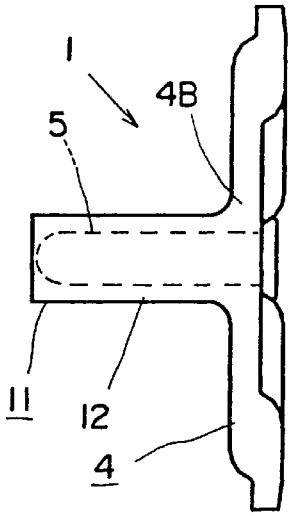
FIG. 4 is a side view showing an interior side of the striker.

One embodiment of the present invention will be described by using drawings. A striker 1 for a vehicle door latch device according to the present invention comprises a metal base plate 4 which is firmly attached to a vehicle body 2 (FIG. 7) by screws or bolts 3, 3, and a substantially U-shaped metal rod 5 fastened to the base plate 4. The base plate 4 includes in the central portion thereof a raised portion

6 projecting forward from the base plate. On both sides of the raised portion 6 of the base plate 4 are respectively formed attaching holes 7, 7 into which the screws 3, 3 are inserted.

A well-known vehicle door latch device 9 is attached to a door 8 of the vehicle body 2. The door latch device 9 holds the door 8 in the door-closed state in cooperation with the striker 1.

The U-shaped rod 5 comprises an outside leg portion 5A which is engageable with a latch 10 of the door lath device 9, an inside leg portion 5B which is in parallel with the outside leg portion 5A, and a bridge portion 5C which connects each tip of the leg portions 5A, 5B. The leg portions 5A, 5B are projecting toward the door 8 in the direction perpendicular to a plane of the base plate 4. The bridge portion 5C is in parallel with the plane the base plate 4.

The base plate 4 comprises an exterior side 4A facing toward the outside of the vehicle body 2 and an interior side 4B facing toward a cabin of the vehicle body 2. The outside leg portion 5A which is engageable with the latch 10 is fastened to the exterior side 4A of the base plate 4, and the inside leg portion 5B is fastened to the interior side 4B of the base plate 4.

Figure 5:
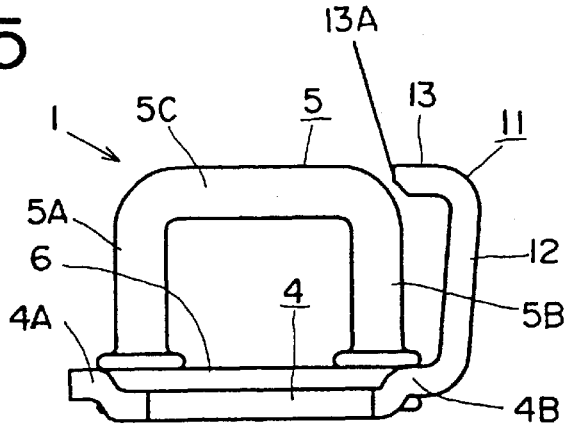
FIG. 5 is a plan view of the striker.
Figure 6:
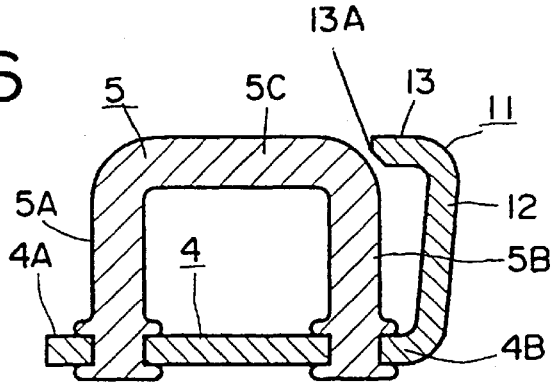
FIG. 6 is a cross sectional view taken on line X—X of FIG. 1.

A block member 11 is formed at a peripheral edge portion of the interior side 4B of the base plate 4, as a one piece unit with base plate 4. The block member 11 comprises a block stay 12 extending toward the door 8 from the base plate 4 and a block portion 13 formed at a tip of the block stay 12. It is desirable to make the block stay 12 in parallel with the leg portions 5A, 5B as much as possible. The block stay 12 and the leg portions 5A, 5B are aligned in the lateral direction. The block portion 13 is preferably formed in parallel with the bridge portion 5C, and the block portion 13 is arranged such that it is opposed to an inside metal panel 14 of the door 8 when the door 8 is closed. Furthermore, a front surface of the block portion 13 is arranged on the same plane as a front surface of the bridge portion 5C, so as both front surfaces have a corresponding shape or it is a little projected toward the door 8 from the front surface of the bridge portion 5C. Further, as shown in FIGS. 5 and 6 a free end 13A of block portion 13 is spaced apart from bridge portion 5C.

Figure 7:
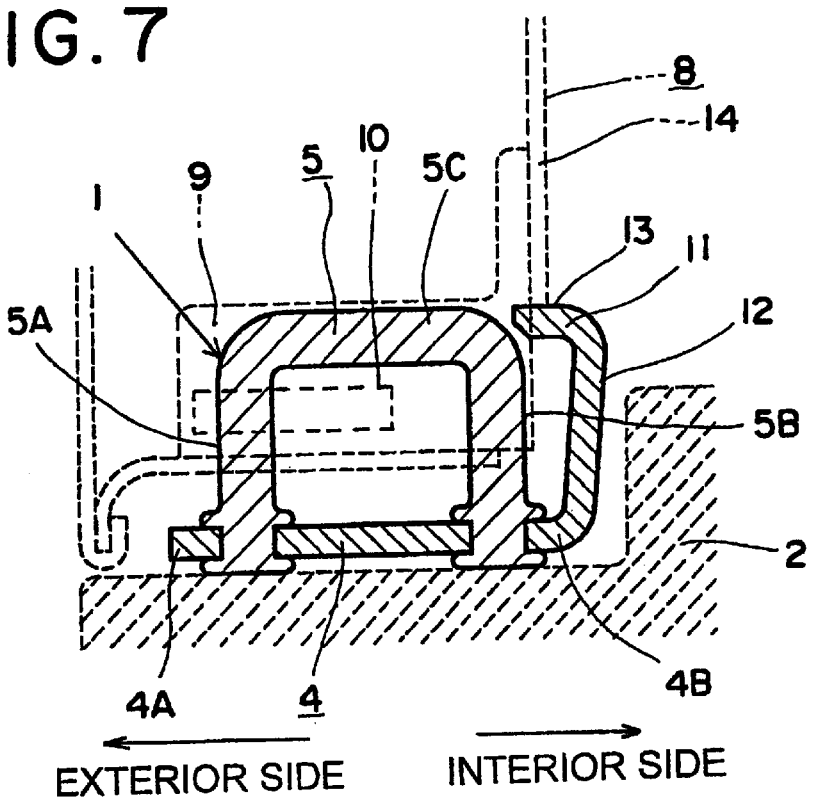
FIGS. 7 and 8 are cross sectional views showing the relation between the striker fastened to a vehicle body and a vehicle door latch device fastened to a door.
Figure 8:
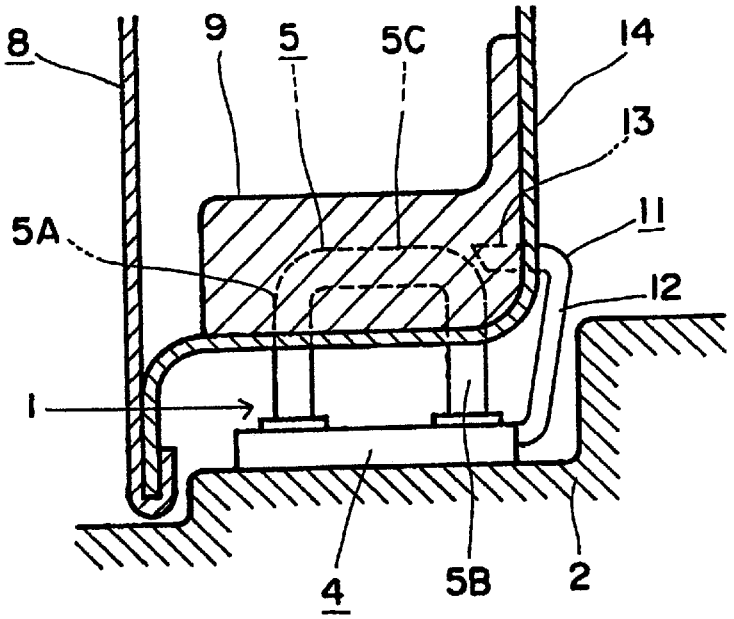
Figure 9:
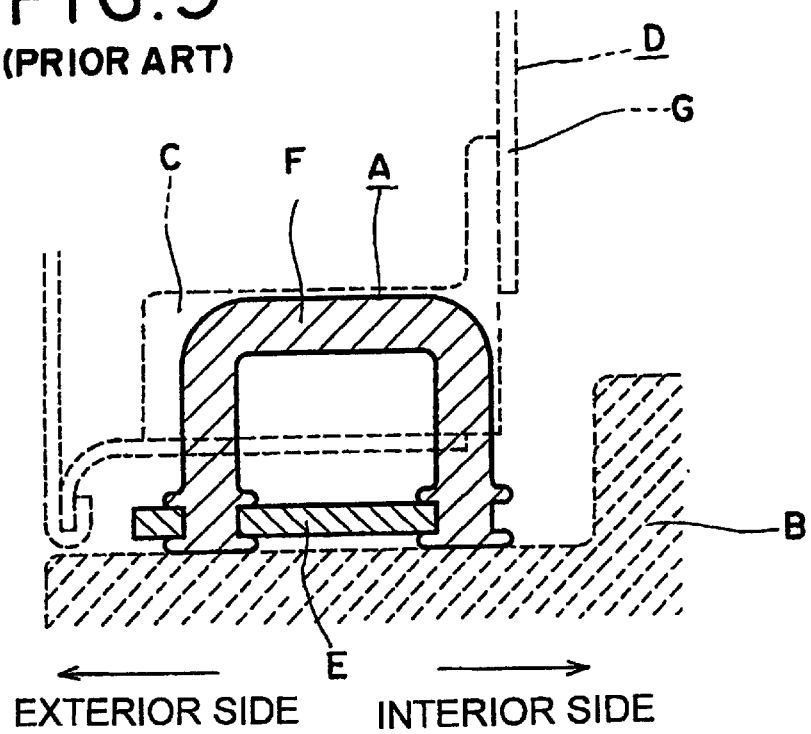
FIG.9 (PRIOR ART)
FIGS. 9 and 10 are cross sectional views showing the relation between a conventional striker fastened to a vehicle body and a conventional vehicle door latch device fastened to a door.
Figure 10:
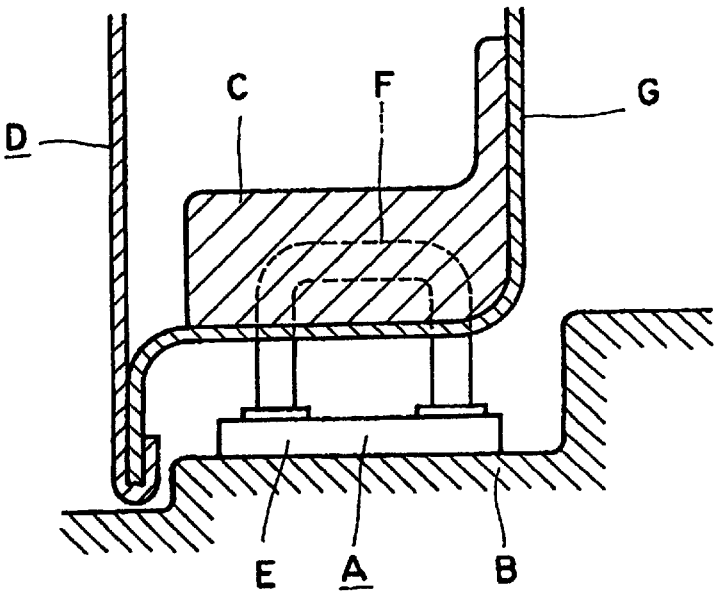
FIG.10 (PRIOR ART)
Figure 11:
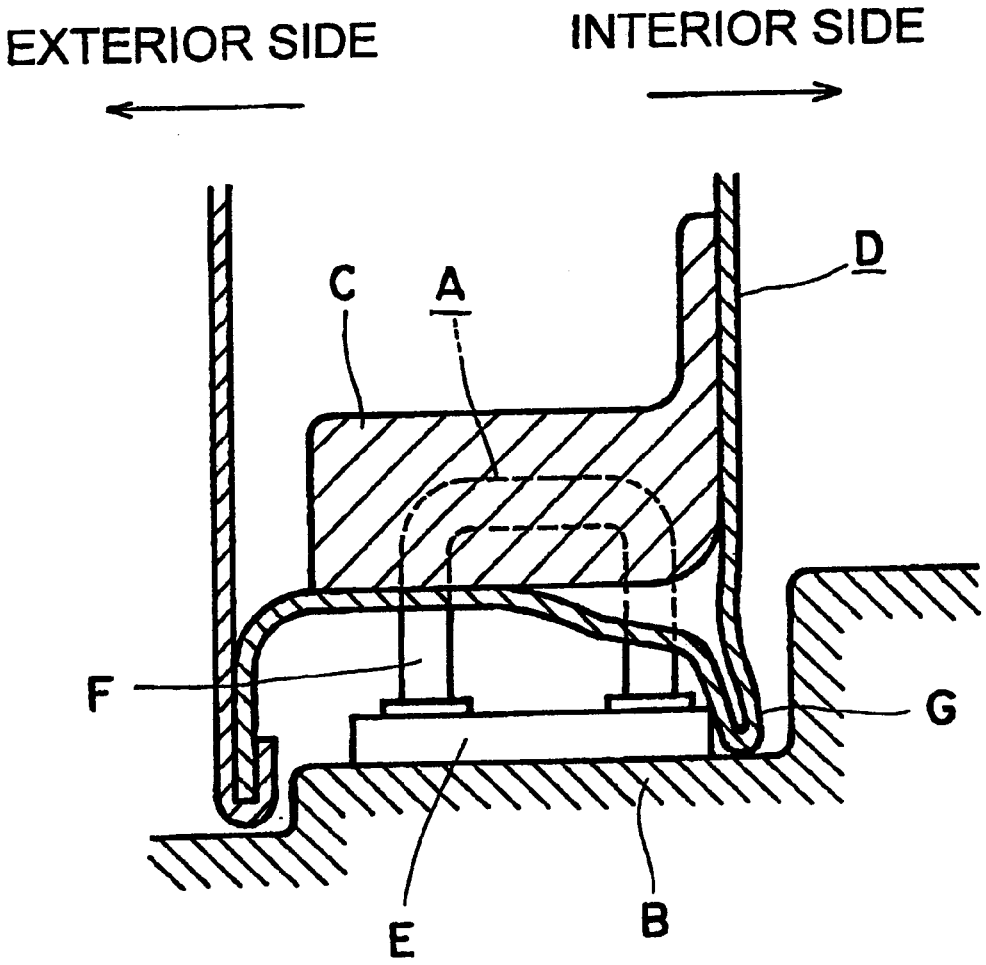
FIG. 11 (PRIOR ART)
FIG. 11 is a cross sectional view showing the situation where a rearward deformed inside metal panel of the door has engageably entered the interior side of the conventional striker.

When the door is in the closed state, as shown in FIGS. 7 and 8 the block portion 13 is opposed the inside panel 14 of the door 8, and therefore, even if the inside metal panel 14 has been deformed toward the striker 1 by an unexpected external force which may act on the door 8, the inside panel 14 is immediately brought into contact with the block portion 13. Therefore, occurrence of engagement between the inside panel 14 and the striker 1 which makes it difficult to open the door 8, is effectively restricted.

What is claimed is:

1. A striker for a vehicle door latch device, comprising:

a metal base plate adapted to be fastened to vehicle body;

a substantially U-shaped metal rod fastened to the base plate, said rod including an outside leg portion which is engageable with a latch of the door latch device and is projected in a given direction perpendicular to a plane of the base plate, an inside leg portion which is in parallel with the outside leg portion, and a bridge portion which connects a tip of the outside leg portion and a tip of the inside leg portion, said outside leg portion being provided at an exterior side of the base plate; and a block member formed on the base plate;

wherein said block member has a block stay which extends substantially in parallel with the outside leg portion from an interior side opposite to the exterior side of the base plate and block portion which is formed at a tip of the block stay, wherein the block portion is substantially coplanar with and spaced apart at a free end from the bridge portion.

2. The striker for a vehicle door latch device according to claim 1, wherein said block member is formed as a unit with said base plate.

3. The striker for a vehicle door latch device according to claim 1, wherein a front surface of said block portion corresponds in shape with a front surface of said bridge portion.

4. The striker for a vehicle door latch device according to claim 1, wherein a front surface of said block portion is projected in a given direction from a front surface of said bridge portion toward the vehicle door.

5. A striker for a vehicle door latch device in combination of a vehicle body and a vehicle door, comprising:

a metal base plate fastened to the vehicle body;

a substantially U-shaped metal rod fasted to the base plate, said rod including an outside leg portion which projects from the base plate toward the door, an inside leg portion which is in parallel with the outside leg portion, and a bridge portion which connects a tip of the outside leg portion and a tip of the inside leg portion; and a block member formed on the base plate, said block member including a block stay which extends substantially in parallel with the outside leg portion from the base plate and a block portion which is formed at a tip of the block stay and spaced apart at a free end from the bridge portion, wherein said block portion is arranged such that the block portion is opposed to an inside metal panel of the door when the door is in a closed state, thereby when said inside metal panel is deformed by an external force to approach the base plate, said block portion is brought into contact with inside metal panel to restrict a further approach of the inside metal panel toward the base plate.

6. The striker for a vehicle door latch device according to claim 5, wherein said block member is formed as a unit with the base plate.

7. The striker for a vehicle door latch device according to claim 5, wherein a front surface of said block portion corresponds in shape with a front surface of the bridge portion.

8. The striker for a vehicle door latch device according to claim 5, wherein a front surface of said block portion is projected in a given direction from a front surface of said bridge portion toward the vehicle door.

* * * * *